US008159444B2

(12) United States Patent
Go

(10) Patent No.: US 8,159,444 B2
(45) Date of Patent: Apr. 17, 2012

(54) GATE DRIVER, DISPLAY DEVICE HAVING THE SAME AND METHOD OF DRIVING THE SAME

(75) Inventor: Seong-Hyun Go, Yogin-si (KR)

(73) Assignee: Samsung Electronics Co., Ltd. (KR)

( * ) Notice: Subject to any disclaimer, the term of this patent is extended or adjusted under 35 U.S.C. 154(b) by 1108 days.

(21) Appl. No.: 11/348,799

(22) Filed: Feb. 6, 2006

(65) Prior Publication Data

US 2006/0176264 A1 Aug. 10, 2006

(30) Foreign Application Priority Data

Feb. 5, 2005 (KR) ..... 10-2005-0010928

(51) Int. Cl.
*G09G 3/36* (2006.01)

(52) U.S. Cl. ..... 345/100; 345/88; 345/92

(58) Field of Classification Search ..... 345/98–100
See application file for complete search history.

(56) References Cited

U.S. PATENT DOCUMENTS 5,436,747 A * 7/1995 Suzuki ..... 349/42
6,335,778 B1 * 1/2002 Kubota et al. ..... 349/151
6,445,372 B1 * 9/2002 Asai ..... 345/99
2001/0028429 A1 * 10/2001 Wu ..... 349/139
2003/0016202 A1 * 1/2003 Edwards et al. ..... 345/98
2003/0057853 A1 * 3/2003 Ino ..... 315/169.3
2004/0041769 A1 * 3/2004 Yamashita et al. ..... 345/93
2004/0109103 A1 * 6/2004 Ota et al. ..... 349/56
2005/0083319 A1 * 4/2005 Kodate et al. ..... 345/204
2006/0097971 A1 * 5/2006 Lee et al. ..... 345/89
2006/0146242 A1 * 7/2006 Kim et al. ..... 349/129
2006/0176265 A1 * 8/2006 Kim et al. ..... 345/100
2006/0267909 A1 * 11/2006 Hsu et al. ..... 345/100

* cited by examiner

*Primary Examiner* — Chanh Nguyen
*Assistant Examiner* — Robert Stone
(74) *Attorney, Agent, or Firm* — Cantor Colburn LLP

(57) ABSTRACT

A gate driver includes a shift register part and an output control part. The shift register part sequentially shifts a first pulse signal in response to a clock to output a second pulse signal. The output control part converts the second pulse signal based on a first control signal to output a main pulse signal to a main gate line, and converts the second pulse signal in response to the first control signal and a second control signal to output a sub pulse signal having an adjusted output timing and an adjusted pulse width to a sub gate line. Thus, a liquid crystal display device having the gate driver may improve display quality thereof and reduce a size thereof.

25 Claims, 13 Drawing Sheets

300

GATE DRIVER, DISPLAY DEVICE HAVING THE SAME AND METHOD OF DRIVING THE SAME

This application claims priority to Korean Patent Application No. 2005-10928, filed on Feb. 5, 2005 and all the benefits accruing therefrom under 35 U.S.C. §119, and the contents of which in its entirety are herein incorporated by reference.

BACKGROUND OF THE INVENTION

1. Field of the Invention

The present invention relates to a gate driver, a display device having the gate driver, and a method of driving the gate driver. More particularly, the present invention relates to a gate driver having an enhanced driving speed and a reduced area, a display device having the gate driver, and a method of driving the gate driver.

2. Description of the Related Art

In general, a liquid crystal display ("LCD") device displays an image using optical and electrical properties of liquid crystal, such as an anisotropic refractive index, an anisotropic dielectric constant, etc. The LCD device has characteristics, such as, for example, lighter weight structure, lower power consumption, lower driving voltage, etc., in comparison with other display devices such as a cathode ray tube, a plasma display panel, etc.

Recently, an LCD device with a dual-TFT structure per a pixel has been developed so as to improve a contrast ratio ("CR"). In other words, the dual-TFT structure is each formed corresponding to two pixels, i.e. main and sub pixels.

For the dual-TFT structure, there need a higher driving frequency for the TFTs, another gamma reference voltage, and a longer charging time than a single-TFT structure. Therefore, it results in increasing an occupied area and generating an additional cost.

BRIEF SUMMARY OF THE INVENTION

The present invention provides a gate driver having an enhanced driving speed and a reduced area.

The present invention also provides a method for driving the gate driver.

The present invention also provides a display device having the gate driver.

In exemplary embodiments, a gate driver for driving a main gate line connected to a main switching device and a sub gate line connected to a sub switching device in a pixel area includes a shift register part and an output control part. The shift register part sequentially shifts a first pulse signal in response to a clock to output a second pulse signal. The output control part converts the second pulse signal based on a first control signal to output a main pulse signal to the main gate line, and converts the second pulse signal in response to the first control signal and a second control signal to output a sub pulse signal having an adjusted output timing and an adjusted pulse width to the sub gate lines.

The output control part includes a main control part controlling the second pulse signal to generate the main pulse signal and a sub control part adjusting the output timing and the pulse width of the second pulse signal to generate the sub pulse signal.

In other exemplary embodiments a display device includes a display panel having a main pixel and a sub pixel in a pixel area, a gate driver, and a timing controller. The gate driver outputs a main pulse signal for the main pixel and outputs a sub pulse signal for the sub pixel within a time period while the main pulse signal is outputted. The timing controller outputs a plurality of control signals and a clock to drive the gate driver.

In still other exemplary embodiments, in a method of driving a main gate line connected to a main switching device and a sub gate line connected to a sub switching device in a pixel area, a first pulse signal is sequentially shifted in response to a clock to output a second pulse signal. The second pulse signal is converted based on a first control signal to output a main pulse signal to the main gate line. The second pulse signal is converted in response to the first control signal and a second control signal to output a sub pulse signal having adjusted output timing and an adjusted pulse width to the sub gate line.

The output timing and the pulse width of the sub pulse signal are adjusted by the second control signal, and the output timing and the pulse width of the sub pulse signal are formed as the second control signal is inverted.

The sub pulse signal is outputted later than the main pulse signal is outputted and the output of the sub pulse signal is finished earlier than the output of the main pulse signal is finished.

In yet other exemplary embodiments, a gate driver for driving a main gate line connected to a main switching device and a sub gate line connected to a sub switching device in a pixel area, includes an output control part outputting a main pulse signal to the main gate line and a sub pulse signal to the sub gate line, the sub pulse signal outputted to the sub gate line within a time period that the main pulse signal is outputted to the main gate line.

According to the configuration, the LCD device may improve display quality thereof and reduce a size thereof.

BRIEF DESCRIPTION OF THE DRAWINGS

The above and other advantages of the present invention will become readily apparent by reference to the following detailed description when considered in conjunction with the accompanying drawings wherein.

DETAILED DESCRIPTION OF THE INVENTION

Figure 1:
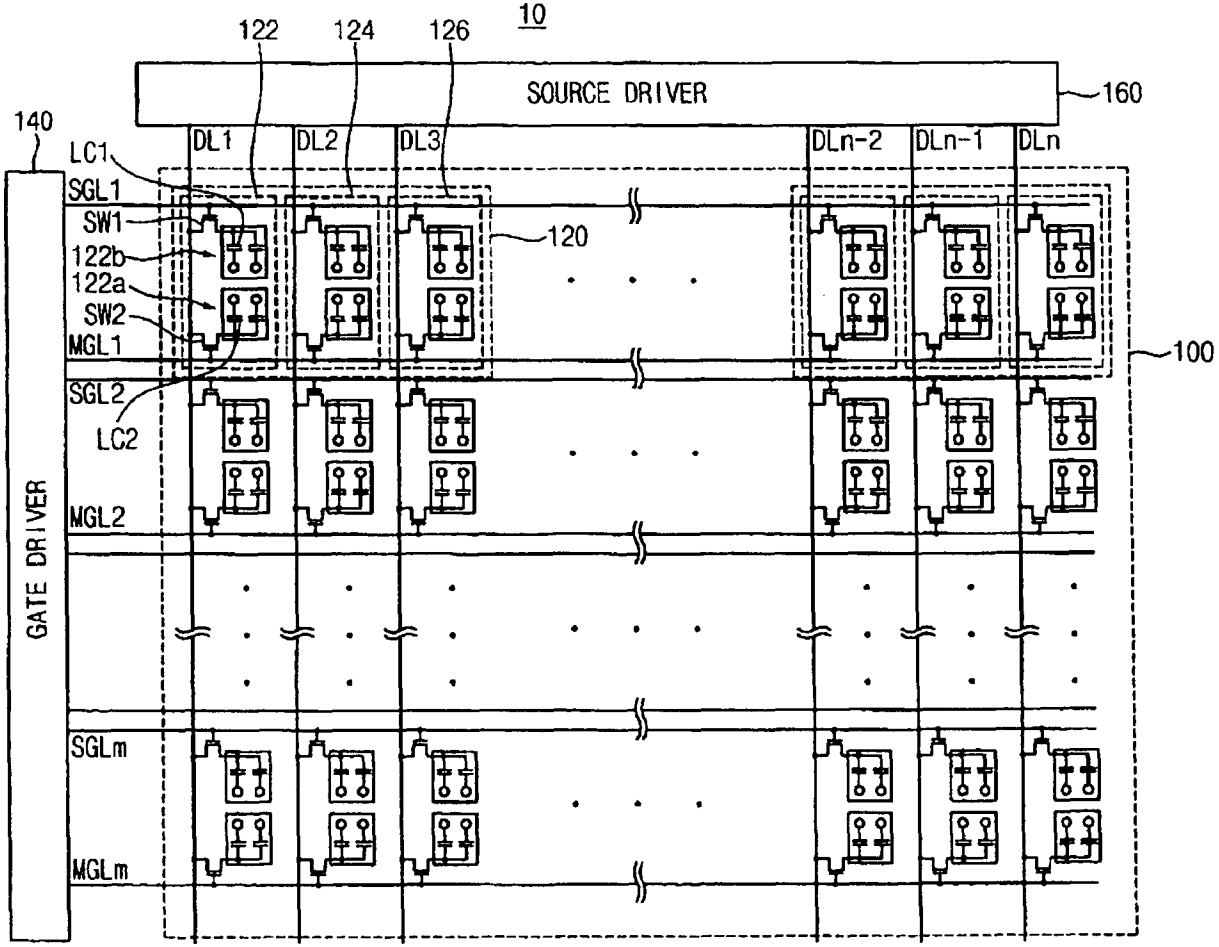
FIG. 1 (PRIOR ART)
FIG. 1 is a block diagram showing a conventional liquid crystal display device.

Hereinafter, the present invention will be explained in detail with reference to the accompanying drawings. In the drawings, some of the features may be exaggerated or an excessive number of certain features may not be shown for clarity. Like numerals refer to like elements throughout.

Figure 2:
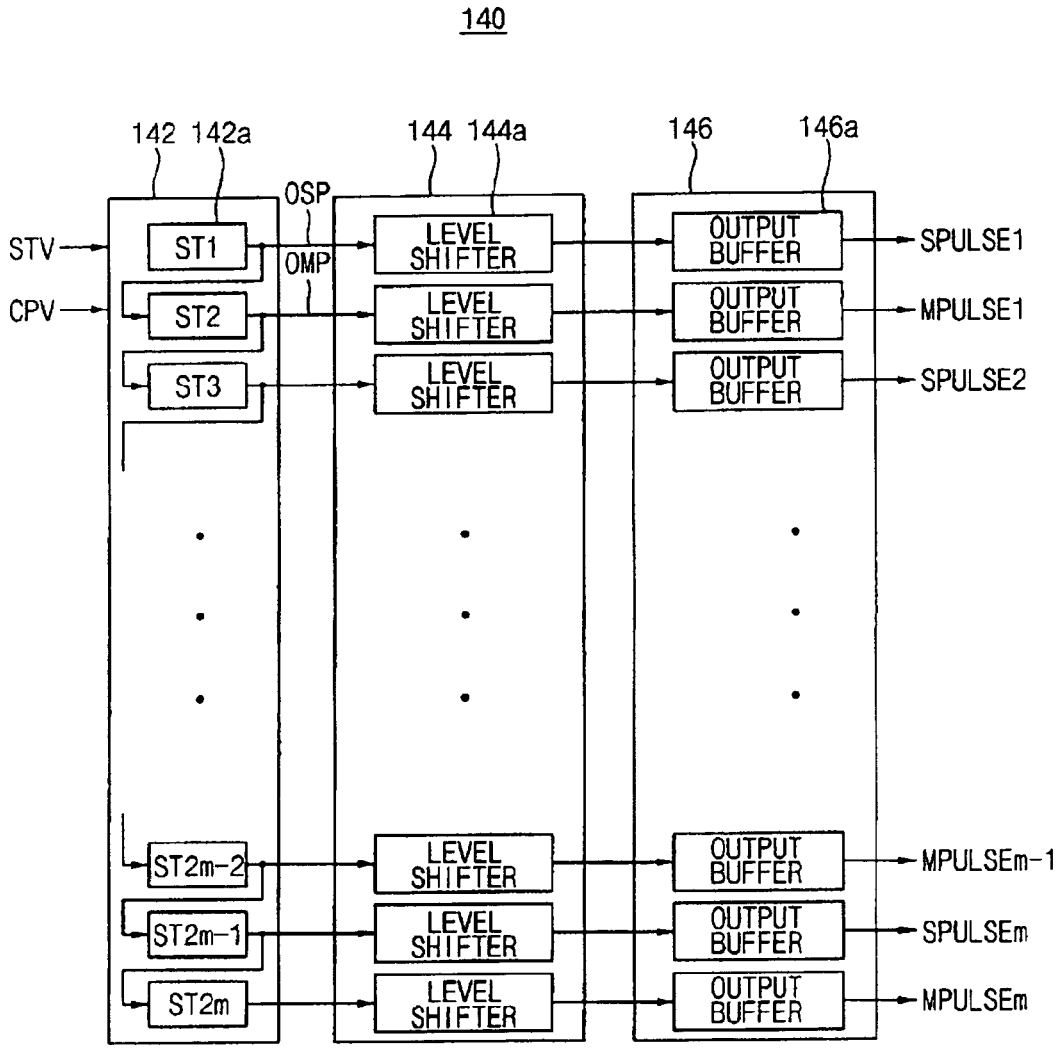
FIG. 2 (PRIOR ART)
FIG. 2 is a block diagram showing a gate driver in FIG. 1.
Figure 3:
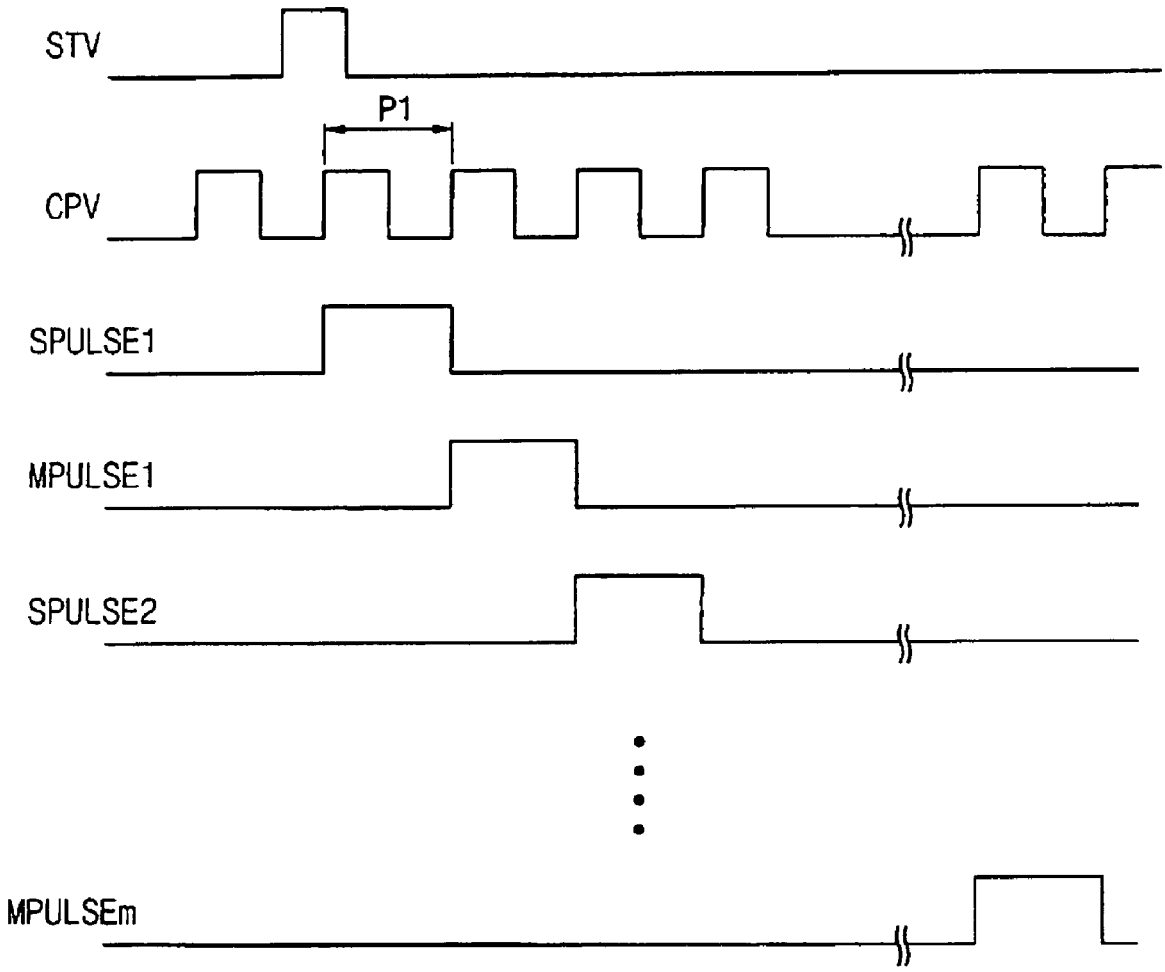
FIG. 3 (PRIOR ART)
FIG. 3 is a waveform diagram illustrating the gate driver in FIG. 2.

FIG. 1 is a block diagram showing a conventional LCD device. FIG. 2 is a block diagram showing a gate driver in FIG. 1. FIG. 3 is a waveform diagram illustrating the gate driver in FIG. 2. In FIGS. 1 to 3, an LCD device having a dual-TFT will be described.

Referring to FIG. 1, a conventional LCD device 10 includes an LCD panel 100, a gate driver 140, and a source driver 160.

The LCD panel 100 includes a plurality of pixels. Each of the pixels 120 includes R, G, and B color pixel areas 122, 124, and 126, and each of the R, G, and B color pixel areas 122, 124, and 126 includes a main pixel 122*a* and a sub pixel 122*b*.

The main pixel 122*a* has a liquid crystal arrangement that differs from a liquid crystal arrangement of the sub pixel 122*b*, thereby improving visibility of the LCD panel 100.

The gate driver 140 is connected to main gate lines MGL and sub gate lines SGL formed on the LCD panel 100. The main gate lines MGL run substantially parallel to the sub gate lines SGL in a first direction. The main and sub gate lines MGL and SGL apply a main pulse signal and a sub pulse signal to the LCD panel 100, respectively, so that TFTs connected to the main and sub gate lines MGL and SGL are sequentially activated.

The source driver 160 is connected to data lines DL formed on the LCD panel 100. The data lines DL are formed substantially perpendicular to the main gate lines MGL and sub gate lines SGL in a second direction. The TFTs activated by the gate driver 140 apply image signals provided through the data lines DL from the data driver 160 to liquid crystal capacitors LC, respectively, to display images. Referring to FIGS. 2 and 3, the gate driver 140 includes a shift register part 142, a level shifter part 144, and an output buffer part 146. The shift register part 142, the level shifter part 144 and the output buffer part 146 include shift registers 142*a*, level shifters 144*a*, and output buffers 146*a*, respectively.

When a vertical start signal STV is applied to the shift register part 142, each of the shift registers 142*a* of the shift register part 142 sequentially shifts the vertical start signal STV and substantially simultaneously outputs a main source pulse signal OMPULSE and a sub source pulse signal OSPULSE in response to a gate clock CPV also applied to the shift register part 142.

During a clock period P1 where the gate clock CPV is transited to a next logic high after transition of the gate clock CPV to a logic high in response to the vertical start signal STV, the main source pulse signal OMPULSE and the sub source pulse signal OSPULSE are sequentially applied to the level shifters 144*a* of the level shifter part 144.

The level shifters 144*a* of the level shifter part 144 convert the main and sub source pulse signals OMPULSE and OSPULSE into a main pulse signal MPULSE and a sub pulse signal SPULSE, respectively, having a voltage level corresponding to a turn-on voltage level of the TFTs. This voltage level corresponds to a voltage level to successfully turn on each associated TFT through the gates of the TFTs as previously described in order to deliver the image signals from the data lines to the main and sub pixels 122*a*, 122*b*. After the level shifters 144*a* of the level shifter part 144 convert the main and sub source pulse signals OMPULSE and OSPULSE into a main pulse signal MPULSE and a sub pulse signal SPULSE, respectively, having the turn-on voltage level of the TFTs, the main and sub pulse signals MPULSE and SPULSE are applied to the output buffer part 146.

The output buffer part 146 sequentially outputs the main and sub pulse signals MPULSE and SPULSE to the main and sub gate lines MGL and SGL connected to the output buffer part 146. According to this configuration, the main and sub pixels 122*a* and 122*b*(see FIG. 1) have different liquid crystal arrangements from each other due to the image signal applied through a data line DL1 of the data lines DL, thereby displaying a predetermined image.

Figure 4:
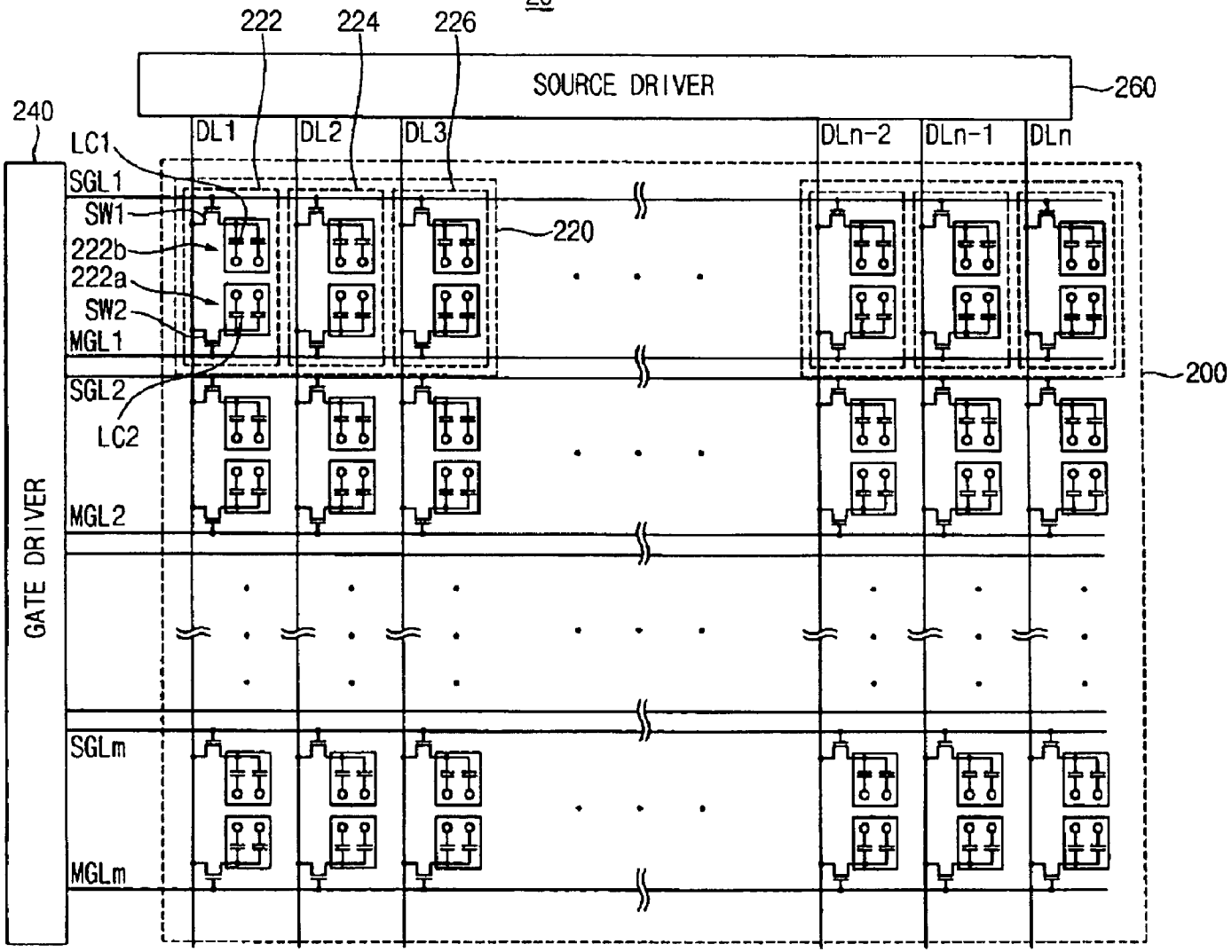
FIG. 4 is a block diagram showing an exemplary embodiment of a liquid crystal display device according to the present invention.

FIG. 4 is a block diagram showing an exemplary embodiment of a LCD device according to the present invention.

Referring to FIG. 4, an LCD device 20 includes an LCD panel 200, a gate driver 240, and a source driver 260.

The LCD panel 200 includes a pixel matrix of which pixels are formed in regions defined by adjacent main and sub gate lines MGL and SGL and a pair of adjacent data lines DL1 to DLn intersected with the main and sub gate lines MGL and SGL, where the data lines DL1 to DLn may be insulated from the main and sub gate lines MGL and SGL by an insulating layer (not shown) in the TFT substrate of the LCD panel 200. Each of the pixels includes a liquid crystal capacitor LC that adjusts a light transmittance in response to a pixel signal and a switching transistor ST that drives the liquid crystal capacitor LC. The switching transistor ST is a thin film transistor ("TFT").

The switching transistor ST1 includes a source connected to a data line DL1, a gate connected to a gate line GL1, and a drain connected to a transparent pixel electrode, such as sub pixel 222*b*. The liquid crystal capacitor LC is formed between the transparent pixel electrode and a transparent common electrode formed on the color filter substrate.

Thus, when the switching transistor ST is selectively activated, the liquid crystal is rearranged due to a voltage applied between the transparent pixel electrode and the transparent common electrode. The light amounts passing through the pixels are adjusted, so that each of the pixels may display various scales.

Also in the LCD panel 200, two TFTs are formed in one color pixel area that displays only one color. That is, one pixel area 220 includes first, second, and third color pixel areas 222, 224, and 226 respectively displaying red, green and blue colors. Each of the three color pixel areas 222, 224, and 226 includes a main pixel 222*a* having a main switching TFT for a front viewing angle of the LCD device 20 and a sub pixel 222*b* having a sub switching TFT for a side viewing angle of the LCD device 20.

For example, the main pixel 222*a* of the first color pixel area 222 is connected to a first main gate line MGL1 and a first data line DL1 by the main switching TFT ST2. When the main switching TFT ST2 connected to the first main gate line MGL1 is activated, the liquid crystal of the first color pixel area 222 has a first arrangement corresponding to the image signal from the first data line DL1 and the voltage applied between the pixel electrode and the common electrode of the first color pixel area 222. Thus, the first color pixel area 222 may adjust the light amount passing therethrough to display a scale of the main pixel 222*a*.

Similarly, the sub pixel 222*b* of the first color pixel area 222 is connected to a first sub gate line SGL1 and a first data line DL1 by the sub switching TFT ST1. When the sub switching TFT ST1 connected to the first sub gate line SGL1 is activated, the liquid crystal of the first color pixel area 222 has a second arrangement different from the first arrangement in response to the image signal from the first data line DL1 and the voltage applied between the pixel electrode and the common electrode of the first color pixel area 222. Thus, the first color pixel area 222 may adjust the light amount passing therethrough to display a scale of the sub pixel 222*b*.

In this embodiment, the main gate lines MGL are defined as even-numbered gate lines of the LCD panel 200 and the sub gate lines SGL are defined as odd-numbered gate lines of the LCD panel 200. Alternatively, the main and sub gate lines MGL and SGL may be defined as the odd-numbered gate lines and the even-numbered gate lines, respectively. In such an embodiment, the positioning of the main pixels 222*a* and the sub pixels 222*b* and their corresponding switching transistors ST2 and ST1 may be reversed.

As described above, the liquid crystal arrangement of the main pixel 222*a* is different from the liquid crystal arrangement of the sub pixel 222*b*, so that the LCD device 20 may prevent deterioration of the visibility thereof due to the viewing angle.

The gate driver 240 is driven in response to a vertical start signal STV externally provided to the gate driver 240 such as by a timing controller, as will be further described below. The gate driver 240 shifts the vertical start signal STV in response to a gate clock CPV and sequentially outputs the main and sub pulse signals MPULSE and SPULSE at a gate high voltage VGH to the main and sub gate lines MGL and SGL. The gate high voltage VGH corresponds to a voltage sufficient for turning on the TFT connected to the respective main and sub gate lines MGL and SGL. When the main and sub pulse signals MPULSE and SPULSE at the gate high voltage VGH are not applied to the main and sub gate lines MGL and SGL, the gate driver 240 outputs a gate low voltage VGL to the main and sub gate lines MGL and SGL.

The source driver 260 shifts a source clock in response to a source start signal to output a sampling signal. The source driver 260 latches the image signal based on the sampling signal and sequentially applies the image signal to the data lines DL1 to DLn in response to a source output enable signal.

Figure 5:
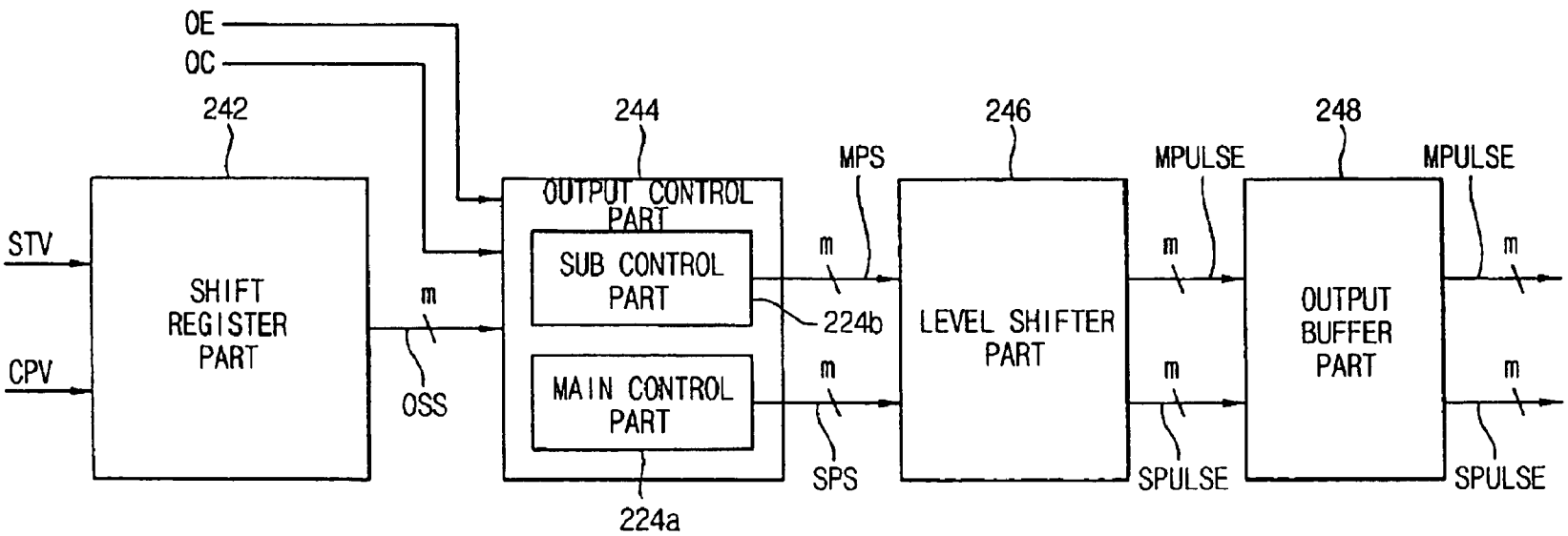
FIG. 5 is a block diagram showing an exemplary gate driver in FIG. 4.
Figure 6:
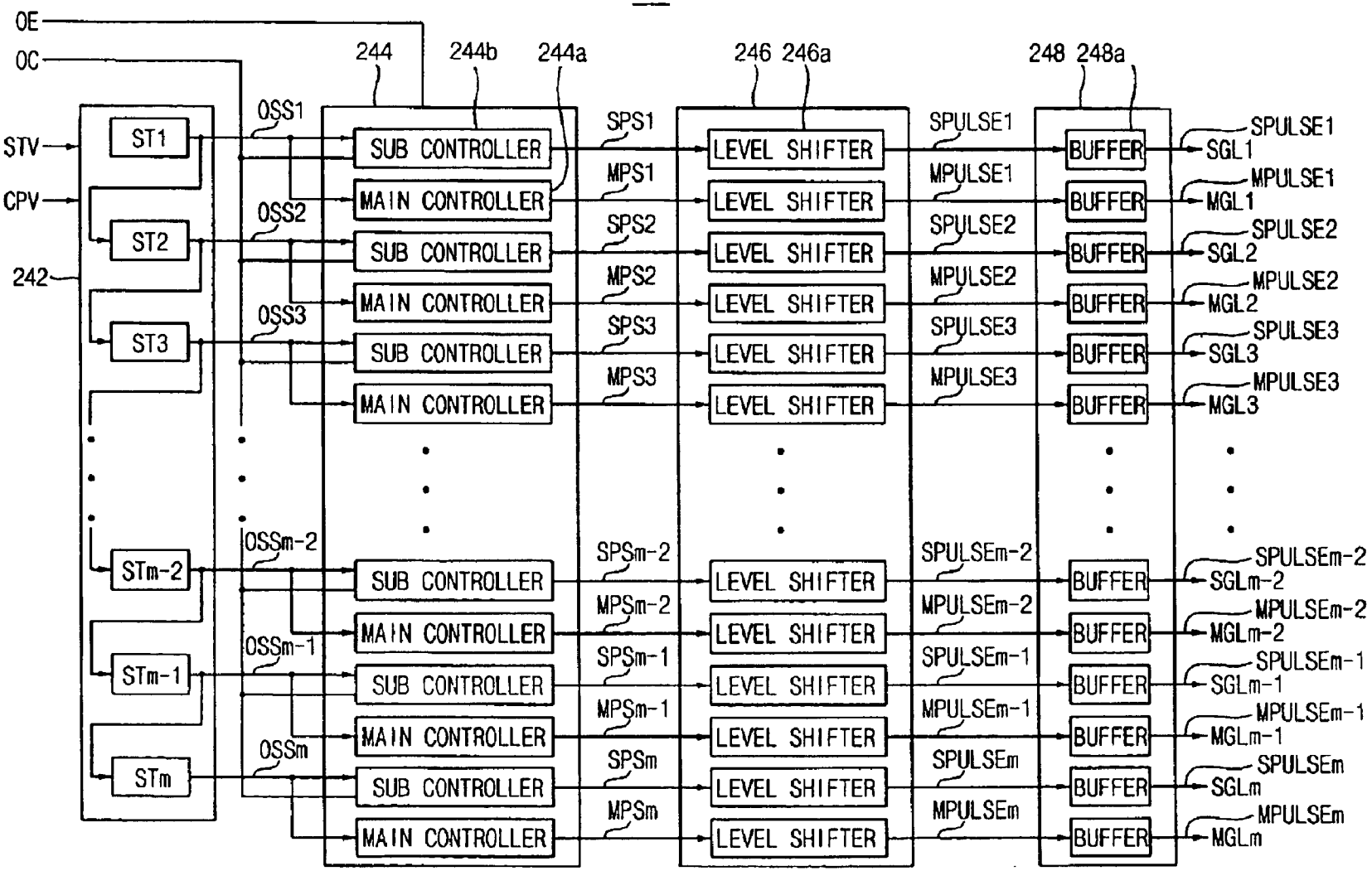
FIG. 6 is a block diagram illustrating in further detail the exemplary gate driver shown in FIG. 5.

FIG. 5 is a block diagram showing an exemplary gate driver in FIG. 4. FIG. 6 is a block diagram illustrating in further detail the exemplary gate driver shown in FIG. 5.

Referring to FIGS. 5 and 6, the gate driver 240 includes a shift register part 242, an output control part 244, a level shifter part 246, and an output buffer part 248.

The shift register part 242 is driven in response to the vertical start signal STV provided externally, such as from a timing controller. The shift register part 242 sequentially shifts the vertical start signal STV in response to the gate clock CPV, also provided externally, such as from a timing controller. The shift register part 242 includes a plurality of stages ST.

When the shift register part 242 is driven, the first stage ST1 receives the vertical start signal STV, and second to m-th stages ST2 to ST1 receive an output signal from previous stages, wherein m is a natural number. For example, stage ST2 receives an output signal from stage ST1, stage ST3 receives an output signal from stage ST2, etc. Each of the stages ST latches the vertical start signal STV and sequentially outputs the vertical start signal STV to next stages in response to the gate clock CPV to output a source scan signal OSS1 to OSS to the output control part 244.

The output control part 244 includes a main control part 244*a*, identified as main controller in FIG. 6, and a sub control part 244*b*, identified as sub controller in FIG. 6.

The main control part 244*a* generates the main pulse signal MPULSE in response to the source scan signal OSS from the shift register part 242 and a first control signal OE externally provided, such as from a timing controller. In this embodiment, the first control signal OE indicates a gate output enable signal OE.

When the gate output enable signal OE is applied to the output control part 244 while the source scan signal OSS from the shift register part 242 is applied to the output control part 244, the main control part 244*a* outputs the source scan signal OSS as the main pulse signal MPULSE to the level shifter part 246. That is, when the source scan signal OSS and the gate output enable signal OE are applied at a logic high, the main control part 244*a* outputs the first main pulse signal MPULSE1 so as to drive the TFT ST2 of the main pixel 222*a* in FIG. 4.

Meanwhile, the sub control part 244*b* controls an output timing and a pulse width of the source pulse signal OSS in response to the source scan signal OSS, the gate output enable signal OE, and a second control signal OC, externally provided such as from a timing controller, to output the sub pulse signal SPULSE to the level shifter part 246. The second control signal OC indicates a gate output control signal OC.

When the source scan signal OSS, the gate output enable signal OE, and the gate output control signal OC have the logic high, the sub control part 244*b* outputs the first sub pulse signal SPULSE1 so as to drive the TFT ST1 of the sub pixel 222*b* in FIG. 4.

The level shifter part 246 shifts voltage levels of the main pulse signal MPULSE from the main control part 244*a* and the sub pulse signal SPULSE from the sub control part 244*b* to an operation voltage level for the LCD panel 200. That is, the main and sub pulse signals MPULSE and SPULSE may have the voltage level to activate the TFTs ST2 and ST1 in the main and sub pixels 222*a* and 222*b* by means of the level shifter part 246.

The output buffer part 248 receives the main and sub pulse signals MPULSE and SPULSE from the level shifter part 246 and sequentially applies the main and sub pulse signals MPULSE and SPULSE to the main and sub gate lines MGL and SGL, respectively, to turn on the associated TFTs ST2 and ST1.

Figure 7:
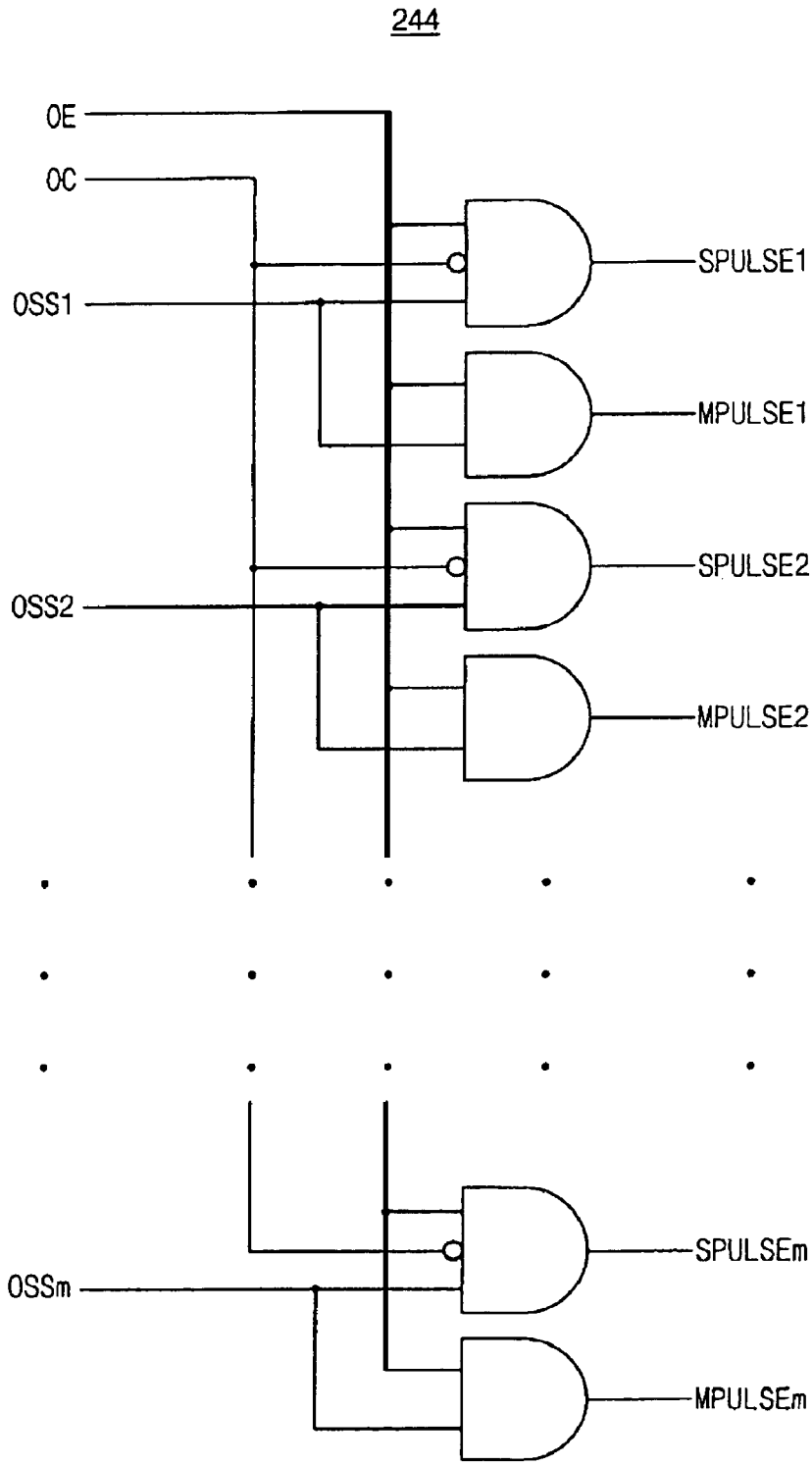
FIG. 7 is a circuit diagram showing an exemplary output control part in FIG. 5.
Figure 8:
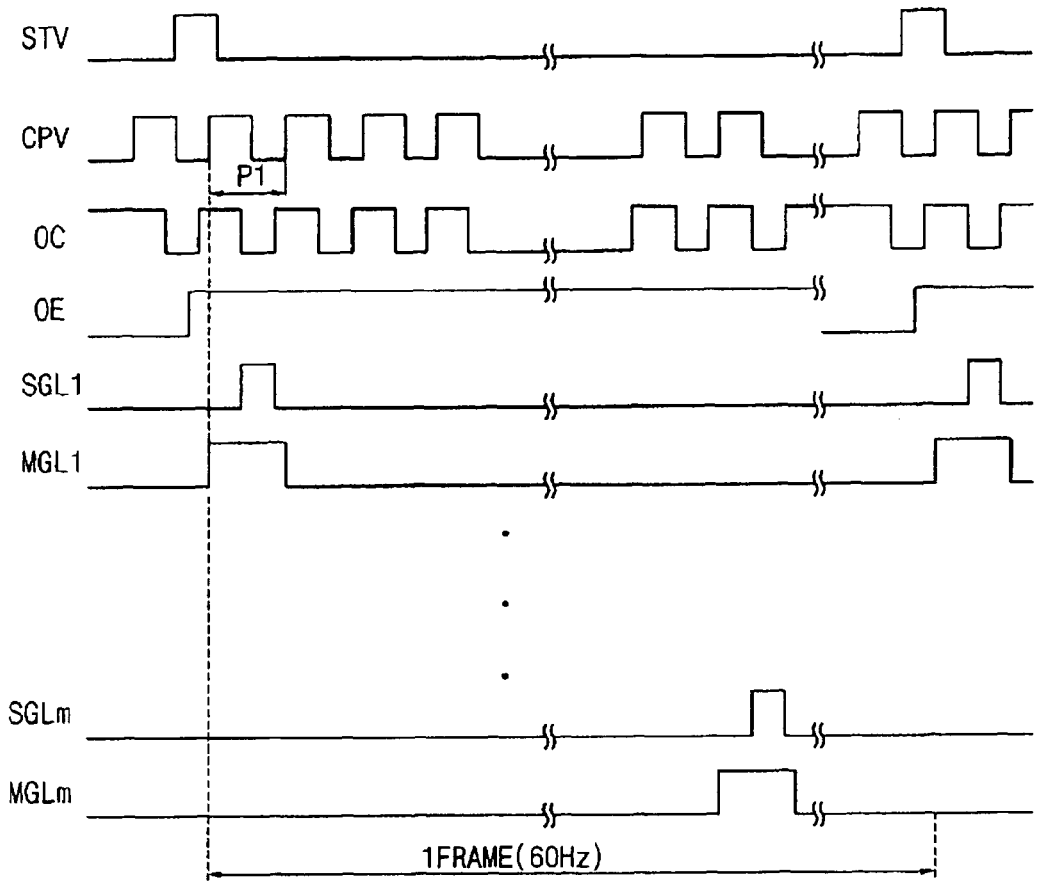
FIG. 8 is a waveform diagram from an exemplary gate driver shown in FIG. 5.

FIG. 7 is a circuit diagram showing an exemplary output control part in FIG. 5. FIG. 8 is a waveform diagram of an exemplary gate driver shown in FIG. 5.

Referring to FIGS. 5 to 8, the output control part 244 includes the main control part 244*a* and the sub control part 244*b*.

The main control part 244*a* includes a plurality of AND gates, each having two input terminals. The AND gates of the main control part 244*a* convert the source scan signal OSS into the main pulse signal MPULSE when the source scan signal OSS and the gate output enable signal OE are substantially simultaneously applied thereto. A number of the AND gates of the main control part 244*a* is equal to a number of the main gate lines MGL formed on the LCD panel 200.

The sub control part 244*b* includes a plurality of AND gates, each having three input terminals. The AND gates of the sub control part 244*b* control the output timing and the pulse width of the source scan signal OSS to output the sub pulse signal SPULSE when the source scan signal OSS, the gate output enable signal OE, and the gate output control signal OC are substantially simultaneously applied thereto. In this embodiment, the gate output control signal OC is applied to the AND gates after a logic value of the gate output control signal OC is inverted. As can be seen in FIG. 8, the signals applied to the sub gate lines SGL are in opposite phase to the logic low level of the gate output control signal OC. A number of the AND gates of the sub control part 244*b* is equal to a number of the sub gate lines SGL formed on the LCD panel 200.

That is, a first sub pixel and a first main pixel are driven in response to the first sub pulse signal SPULSE1 from a first sub controller and a first main pulse signal MPULSE1 from a first main controller, after the first sub pulse signal SPULSE1 and the first main pulse signal MPULSE1 have passed through the level shifter part 246 and the output buffer part 248, thereby displaying the predetermined image.

The shift register part 242 is driven in response to the vertical start signal STV. The shift register part 242 sequentially shifts the vertical start signal STV in response to the gate clock CPV so as to sequentially output the source scan signal OSS. Thus, the gate output enable signal OE is transited from the logic low level to the logic high level while the gate clock CPV is applied to the shift register part 242. Also, the gate output enable signal OE is applied to the output control part 244 before the vertical start signal STV is applied or while the vertical start signal STV is applied to the shift register part 242.

That is, the gate output enable signal OE at the logic high level is applied to the output control part 244 before the vertical start signal STV is applied or while the vertical start signal STV is applied to the shift register part 242.

The main control part 244*a* is activated in response to the vertical start signal STV and the gate output enable signal OE, and the main control part 244*a* outputs the main pulse signal MPULSE having a same pulse width as the source scan signal OSS. The main pulse signal MPULSE is outputted during one clock period P1 where the gate output enable signal OE is transited to the logic high level and the gate clock CPV is transited from the logic high level to the logic low level, as shown in FIG. 8.

When the gate output control signal OC is applied at the logic low level while the gate output enable signal OE is transited to the logic high level, the sub control part 244*b* is activated to output the first sub pulse signal SPULSE1, as demonstrated by the opposite phases of the logic high level of the first sub pulse signal SPULSE1 and the logic low level of the gate output control signal OC. Thus, the output timing of the first sub pulse signal SPULSE1 is determined as the output timing of the source scan signal OSS is determined by the gate output control signal OC. Also, when the gate output control signal OC is applied at the logic high level, the sub control part 244*b* is turned off so as to control the pulse width of the source scan signal OSS, thereby determining the pulse width of the first sub pulse signal SPULSE1. Likewise, when the gate output control signal OC is applied again at the logic low level, the sub control part 244*b* is activated to output the second sub pulse signal SPULSE2, and so on.

Thus, the first sub pulse signal SPULSE1 controls the output timing and the pulse width of the source scan signal OSS in response to the gate output control signal OC. Also, the logic low level of the gate output control signal OC occurs during the pulse width of the main pulse signal MPULSE. Thus, the sub pulse signal SPULSE starts after the beginning of the main pulse signal MPULSE and ends before the end of the main pulse signal MPULSE.

The first main pulse signal MPULSE1 and the first sub pulse signal SPULSE1 are boosted to the operation voltage level suitable for activating the TFTs connected to the first main gate line MGL1 and the first sub gate line SGL1 by the level shifter 246*a* of the level shifter part 246 and the buffer 248*a* of the output buffer part 248, respectively.

Similarly, a second main pulse signal MPULSE2 to an m-th main pulse signal MPULSEm and a second sub pulse signal SPULSE2 to an m-th sub pulse signal SPULSEm are sequentially outputted.

Figure 9:
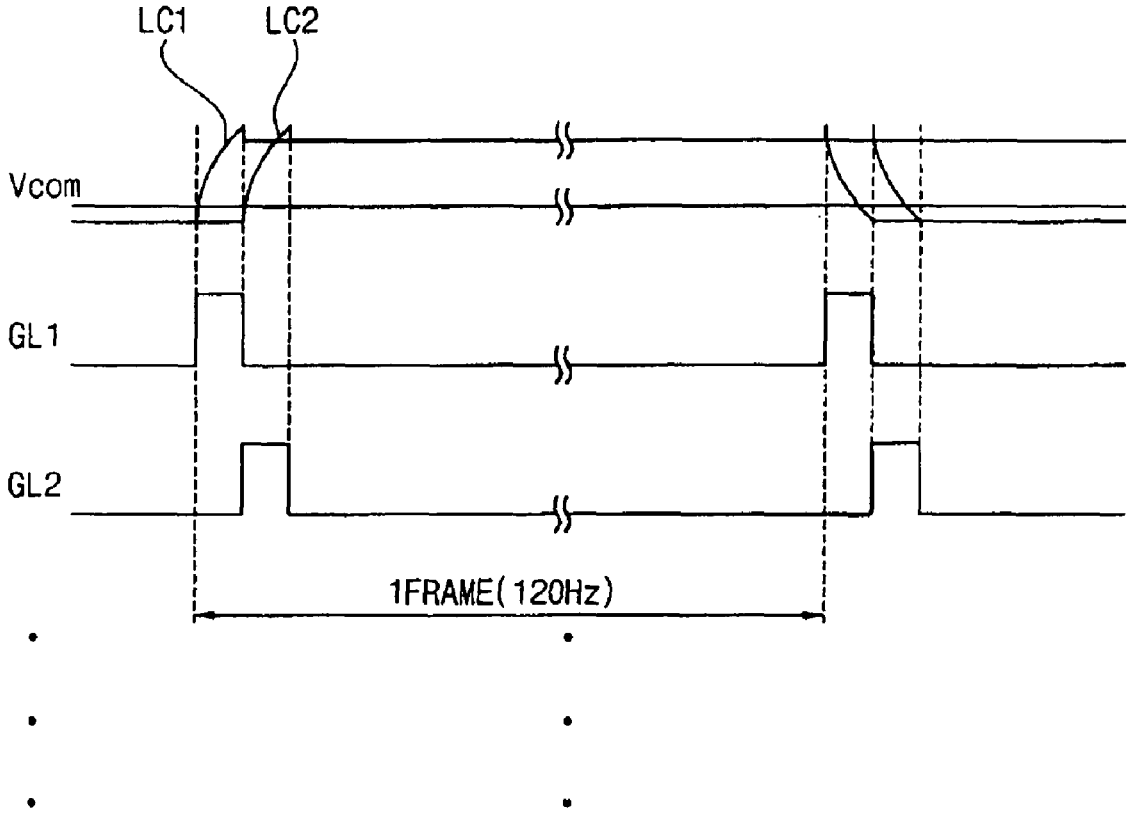
FIG. 9 is a waveform diagram showing correlation between pulse signals applied to gate lines and an electric charge of a liquid crystal capacitor.
Figure 10:
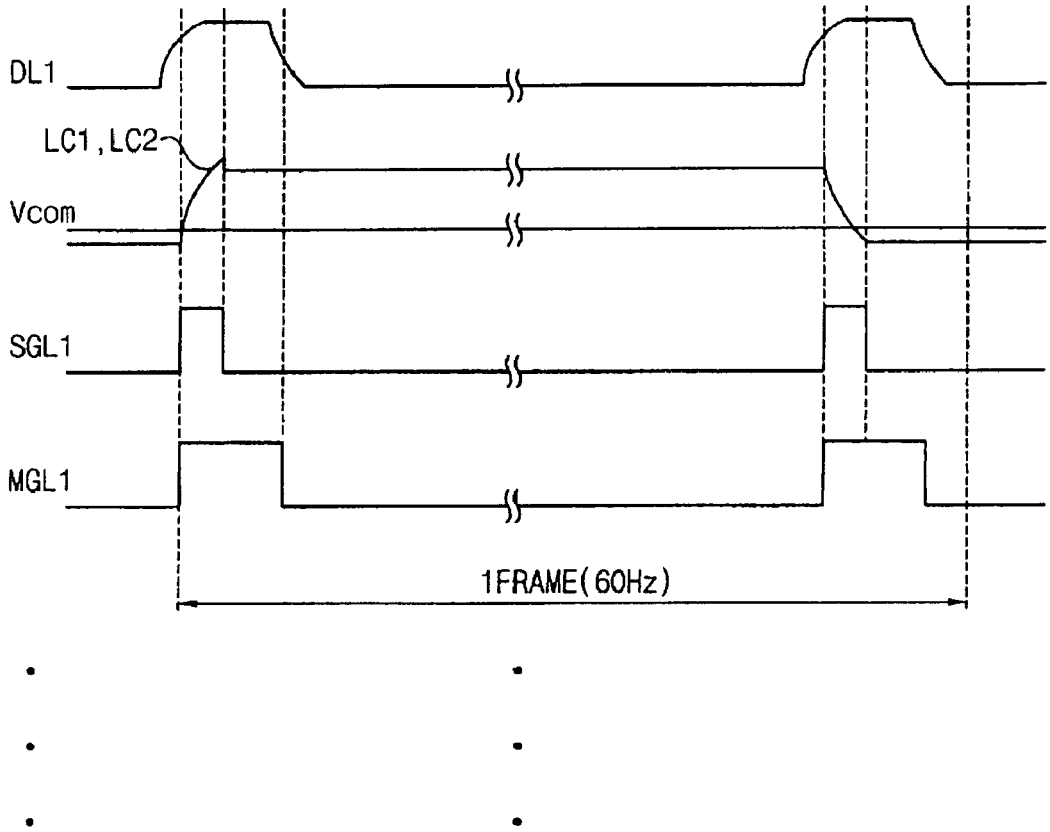
FIG. 10 is a waveform diagram showing correlation between pulse signals applied to gate and data lines and electric charge in a liquid crystal capacitor.
Figure 11:
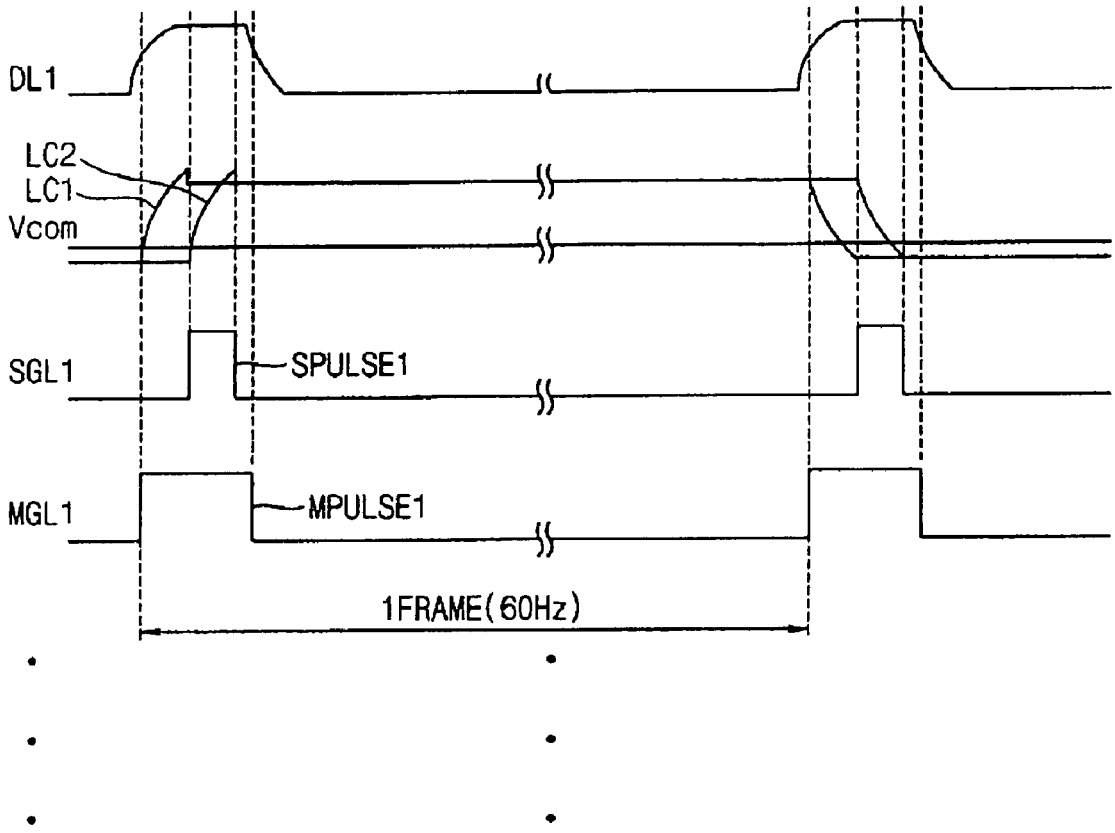
FIG. 11 is a waveform diagram showing correlation between pulse signals applied to gate and data lines and an electric charge in a liquid crystal capacitor.

FIG. 9 is a waveform diagram showing correlation between pulse signals applied to gate lines and an electric charge of a liquid crystal capacitor. FIG. 10 is a waveform diagram showing correlation between pulse signals applied to gate and data lines and electric charge in a liquid crystal capacitor. FIG. 11 is a waveform diagram showing correlation between pulse signals applied to gate and data lines and an electric charge in a liquid crystal capacitor.

Referring to FIG. 9, in the LCD panel employing a dual-TFT, unlike the embodiments of the present invention, the sub pulse signal and the main pulse signal having a same pulse width are sequentially applied to the sub gate lines SGL and the main gate lines MGL, respectively. In order to display the image of one frame, the LCD panel requires a driving frequency of about 120 Hz, so that the LCD panel has a driving speed of about ½ in comparison with a LCD panel employing a single-TFT. That is, while a driving speed of an LCD panel employing a single-TFT may have a driving frequency of about 60 Hz, the LCD panel employing a dual-TFT as demonstrated by FIG. 9 requires a driving frequency of about 120 Hz.

Also, display quality of the LCD panel is deteriorated since a charge time is not sufficient to charge an electric charge into one liquid crystal capacitor LC.

In order to improve the charge time of the electric charge for the liquid crystal capacitor and the driving speed of the LCD panel, the sub pulse signal and the main pulse signal may be sequentially applied to the sub and main gate lines SGL and MGL as shown in FIG. 10.

Referring to FIG. 10, the sub and main pulse signals at the gate high voltage VGH are substantially simultaneously applied to the sub gate line SGL and the main gate line MGL corresponding to one pixel area. Further, the main pulse signal has a pulse width greater than a pulse width of the sub pulse signal. Thus, while the sub and main pulse signals begin at the same time, the sub pulse signal ends prior to the end of the main pulse signal. In this embodiment, the first data line DL1, the first sub gate line SGL1, and the first main gate line MGL1 will be described in FIG. 10.

The image signal applied through the data line DL is delayed for a predetermined time due to RC delay. Thus, when the main and sub pulse signals are applied as shown in FIG. 10, the liquid crystal capacitor LC2 in the first main pixel may have enough charge time to charge the electric charge thereinto in response to a first main pulse MPULSE1 applied to the first main gate line MGL1. Also, the first main pixel may have enough transmission time to stably transmit the image signal applied through the first data line DL1 while the switching transistor ST2 in the first main pixel is activated due to the first main pulse signal MPULSE1, thereby improving the visibility at a front viewing angle.

On the other hand, the first sub pixel may not have enough transmission time to stably transmit the image signal applied through the first data line DL1 while the switching transistor ST1 in the first sub pixel is activated due to the first sub pulse signal SPULSE1 having a shorter pulse width than the first main pulse signal MPULSE1 and ending well before an end of the first main pulse signal MPULSE1, so that the visibility at a side viewing angle may not be improved.

In FIG. 11, the first data line DL1, the first sub gate line SGL1 and the first main gate line MGL1 will be described.

Referring to FIG. 11, the first sub pulse signal SPULSE1 is applied to the first sub gate line SGL1 to activate the first sub pixel 222*b* after the first main pixel 222*a* is activated as the first main pulse signal MPULSE1 is applied to the first main gate line MGL1. The first sub pulse signal SPULSE1 is applied to the first sub gate line SGL1 for a predetermined time when the first main pulse signal MPULSE1 at the logic high level is applied to the first main gate line MGL1. That is, the first sub pulse signal SPULSE1 begins after the beginning of the first main pulse signal MPULSE1, and the first sub pulse signal SPULSE1 ends before the end of the first main pulse signal MPULSE1, such that the first sub pulse signal SPULSE1 occurs completely during the first main pulse signal MPULSE1.

Thus, the LCD panel of the embodiments of the present invention requires the driving frequency of about 60 Hz so as to display the image for one frame. Thus the exemplary embodiments of the LCD panel of the present invention employing the dual-TFT may be driven in a same driving speed as that of an LCD panel employing the single-TFT.

Also, due to a delay in the onset of the first sub pulse signal SPULSE1, when the first main pulse MPULSE1 is applied to the first main gate line MGL1 connected to the first main pixel 222*a* to apply the image signal to the first main pixel 222*a*, the first sub pulse signal SPULSE1 is applied to the first sub gate line SGL1 connected to the first sub pixel 222*b* after a predetermined time so as to apply the image signal to the first sub pixel 222*b*.

Thus, although the image signal applied to the sub pixel through the data line DL is delayed, the LCD panel may have improved visibility at a side viewing angle thereof since the sub pixel may have enough transmission time to stably receive the image signal applied through the data line DL.

Referring back to FIG. 10, the main and sub pixels may not receive different image signals from each other through one data line DL, but the main and sub pixels may receive different image signals from each other through one data line DL as shown in FIG. 11. The occurrence of the sub pulse signal SPULSE within the pulse width of the main pulse signal MPULSE may be altered as necessary by the gate output control signal. That is, shifting the onset of logic low levels within the gate output control signal in relation to the vertical start signal STV would shift the occurrence of the sub pulse signal SPULSE within the occurrence of the main pulse signal MPULSE.

The LCD device employing the dual-TFT of the present embodiment may display the image signal corresponding to one frame for a substantially same time as that of the LCD device employing one TFT. Further, the LCD device may have enough charge time to charge the liquid crystal capacitor LC and the visibility at the front viewing angle as well as at the side viewing angle may be improved.

Furthermore, the exemplary embodiments of the LCD device according to the present invention may reduce an area in which the gate driver is formed, so that the LCD device may be applied to a small-sized LCD device as well.

Figure 12:
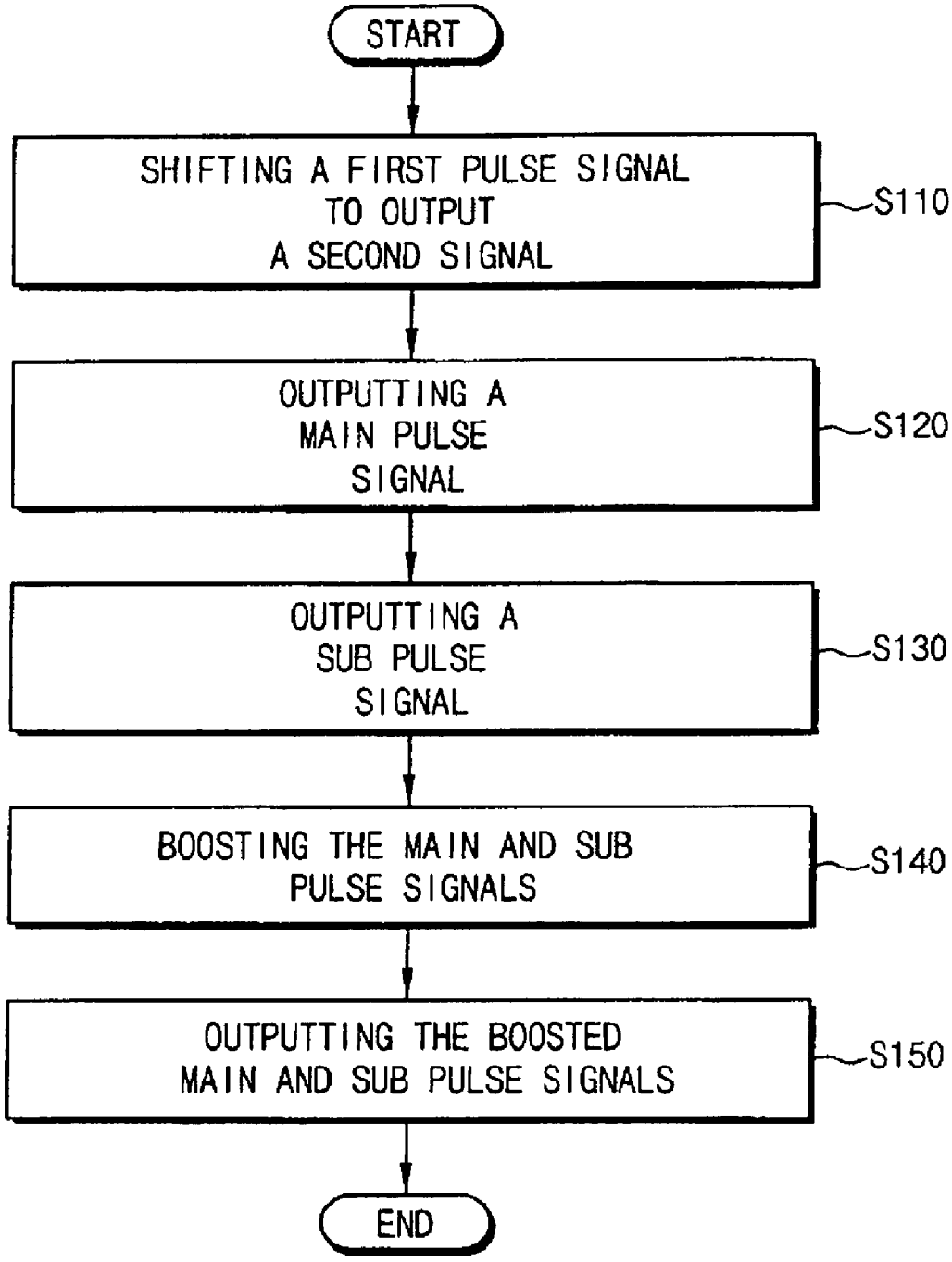
FIG. 12 is a flowchart illustrating an exemplary embodiment of a gate driving method according to the present invention.

FIG. 12 is a flowchart illustrating an exemplary embodiment of a gate driving method according to the present invention.

Referring to FIG. 12, as demonstrated by step S110, the gate driver sequentially shifts the externally provided first pulse signal (vertical start signal STV) in response to the clock to output the second pulse signal OSS. As demonstrated by step S120, the gate driver outputs the main pulse signal MPULSE in response to the second pulse signal OSS and the externally provided first control signal OE.

Also, as demonstrated by step S130, the gate driver controls the output timing and the pulse width of the second pulse signal (the source scan signal) OSS in response to the first control signal (the gate output enable signal) OE and the externally provided second control signal OC so that the sub pulse signal SPULSE is outputted.

Then, the gate driver sequentially boosts the main pulse signal MPULSE and the sub pulse signal SPULSE to the operation voltage level for the LCD panel as shown in step S140, and sequentially outputs the boosted main pulse signal MPULSE and the boosted sub pulse signal SPULSE through the output lines as shown in step S150.

More particularly, in step S110, the shift register part 242 (see FIG. 5) is driven in response to the first pulse signal STV, and the shift register part 242 sequentially shifts the first pulse signal STV in response to the gate clock CPV. Also, each of the stages ST of the shift register part 242 sequentially outputs the first pulse signal STV in response to the gate clock CPV to output the second pulse signal OSS.

In step S120, the main control part 244*a* (see FIG. 5) of the output control part 244 (see FIG. 5) outputs the main pulse signal MPULSE in response to the source scan signal OSS and the first control signal OE. In this embodiment, the first control signal OE indicates the gate output enable signal OE.

When the source scan signal OSS and the gate output enable signal OE are inputted at the logic high level, the main pulse signal MPULSE is outputted at the logic high level during one clock period P1 of the gate clock CPV, as previously shown in FIG. 8.

In step S130, the sub control part 244*b* (see FIG. 5) of the output control part 244 (see FIG. 5) outputs the sub pulse signal SPULSE in response to the source scan signal OSS, the gate output enable signal OE, and the second control signal OC. In this embodiment, the second control signal OC indicates the gate output control signal.

When the source scan signal OSS and the gate output enable signal OE are inputted at the logic high level and the gate output control signal OC is inputted at the logic low level, the sub control part 244*b* outputs the sub pulse signal SPULSE while the gate output control signal OC is inputted in response to the inverted gate output control signal OC, the source scan signal OSS, and the gate output enable signal OE.

That is, the sub pulse signal SPULSE is outputted while the gate output control signal OC is applied at the logic low level, and the sub pulse signal SPULSE is ended when the gate output control signal OC returns to the logic high level.

In step S140, the level shifters 246*a* (see FIG. 6) of the level shifter part 246 (see FIG. 6) sequentially boost the first to m-th main pulse signals and the first to m-th sub pulse signals to the operation voltage level for turning on the associated TFTs of the LCD panel.

That is, in order to sequentially activate TFTs connected to the main and sub gate lines MGL and SGL of the LCD panel, the main and sub pulse signals MPULSE and SPULSE are sequentially boosted to the turn-on voltage level of the TFTs by the level shifter part 246.

In step S150, the main and sub pulse signals boosted by the level shifter part 246 are outputted through the buffers 248*a* (see FIG. 6) of the output buffer part 248 (see FIG. 6) to the main and sub gate lines MGL and SGL.

Figure 13:
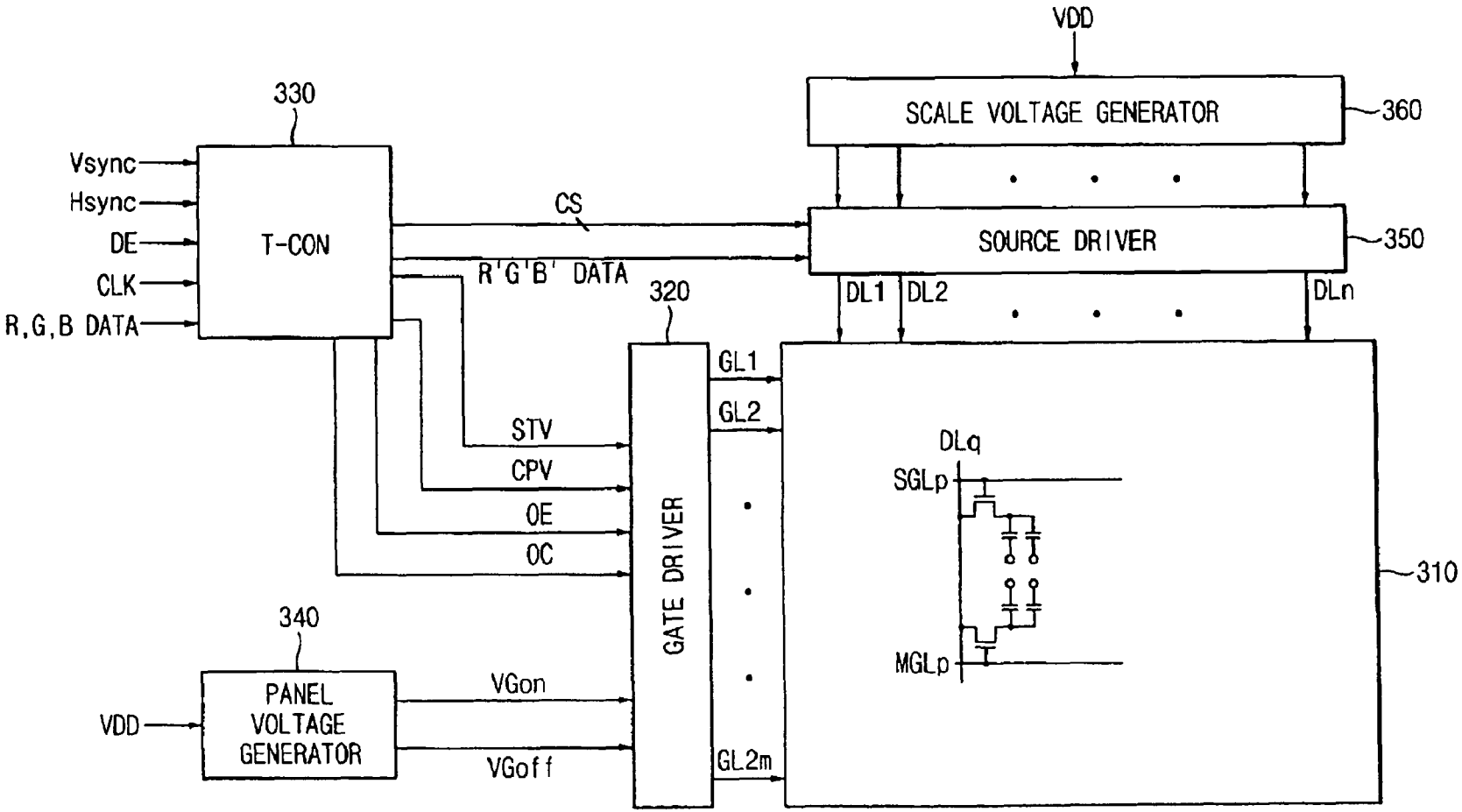
FIG. 13 is a block diagram showing an exemplary embodiment of a liquid crystal display device according to the present invention.

FIG. 13 is a block diagram showing an exemplary embodiment of an LCD device according to the present invention.

Referring to FIG. 13, an LCD device 300 includes an LCD panel 310, a gate driver 320, a timing controller 330, and a panel voltage generator 340.

The LCD panel 310 includes pixels in matrix configuration, the main and sub gate lines MGL and SGL extended in a first direction, and data lines DL1 to DLn extended in a second direction substantially perpendicular to the first direction.

Each of the pixels includes the main gate line MGL, the sub gate line SGL, and the data line DL. Also, each of the pixels includes a liquid crystal capacitor LC and a storage capacitor. The liquid crystal capacitor LC changes a light transmittance to adjust a light amount, and the storage capacitor enhances an electric charge amount.

The gate driver 320 includes a shift register part, an output control part, a level shifter part, and an output buffer part. In this embodiment, the gate driver 320 has a same function and structure as those of the gate driver 240 in FIGS. 4 to 8, and thus any further repetitive descriptions of the gate driver 320 will be omitted.

The timing controller 330 receives a clock signal CLK, a horizontal synchronization signal Hsync, a vertical synchronization signal Vsync, an RGB data signal, and a data enable signal DE. The timing controller 330 outputs a vertical start signal STV, a gate clock CPV, a gate output enable signal OE, and a gate output control signal OC. Also, the timing controller 330 outputs control signals CS to control the source driver 350 and the RGB data signal to display an image.

The panel voltage generator 340 receives a power voltage VDD and outputs a gate-on voltage VGon and a gate-off voltage VGoff to the gate driver 320.

The LCD device 300 further includes a source driver 350 and a scale voltage generator 360 so as to apply an analog type image signal to the LCD panel 310.

The source driver 350 converts the digital type RGB data signal from the timing controller 330 into the analog type RGB data signal and applies the analog type RGB data signal to the data lines DL of the LCD panel 310.

The scale voltage generator 360 receives a power voltage VDD and applies a scale voltage to the source driver 350 so as to control the light transmittance of the liquid crystal within the LCD panel 310.

According to the above, the LCD device 300 employing the dual-TFT per a pixel may display the image at a same driving speed and display speed as those of the LCD device 300 employing the single-TFT per a pixel.

Also, although the image signal is applied to two TFTs through one data line, the LCD device 300 may have enough time to turn on two TFTs, thereby improving display quality thereof.

Further, the gate and data drivers 320 and 350 that drive the LCD panel 310 employing the dual-TFT have reduced areas, thereby reducing the size of the LCD device 300.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A method of driving a main gate line connected to a main switching device to display images on a main pixel in a color pixel area which displays one color and a sub gate line connected to a sub switching device to display images on a sub pixel in the color pixel area which displays the one color, the method comprising:

sequentially shifting a first pulse signal in response to a clock to output a second pulse signal;

converting the second pulse signal based on a first control signal to output a main pulse signal to the main gate line; and converting the second pulse signal in response to the first control signal and a second control signal to output a sub pulse signal having a different output timing and a different pulse width from the main pulse signal to the sub gate line, wherein the main pulse signal and the sub pulse signal are generated in a same stage;

the main switching device and the sub switching device are disposed between the main gate line and the sub gate line adjacent to the main gate line; and the main switching device and the sub switching device of the color pixel area are connected to a same data line comprising an image signal.

2. The method of claim 1, further comprising boosting the main pulse signal and the sub pulse signal.

3. The method of claim 2, further comprising sequentially outputting the boosted main and sub pulse signals through a plurality of output lines.

4. The method of claim 1, wherein converting the second pulse signal in response to the first control signal and a second control signal to output a sub pulse signal having a different output timing and a different pulse width to the sub gate line comprises adjusting the output timing and the pulse width of the sub pulse signal by the second control signal.

5. The method of claim 4, wherein the output timing and the pulse width of the sub pulse signal are generated in response to an inversion signal of the second control signal.

6. The method of claim 5, further comprising outputting the sub pulse signal after the main pulse signal is outputted.

7. The method of claim 5, wherein the pulse width of the sub pulse signal is smaller than a pulse width of the main pulse signal.

8. The method of claim 1, wherein the sub pulse signal is outputted later than the main pulse signal is outputted and output of the sub pulse signal is finished earlier than output of the main pulse signal is finished.

9. The method of claim 1, wherein the main pulse signal comprises a pulse width corresponding to one clock period of the clock.

10. A gate driver for driving a main gate line connected to a main switching device to display images on a main pixel in a color pixel area which displays one color and a sub gate line connected to a sub switching device to display images on a sub pixel in the color pixel area which displays the one color, the gate driver comprising:

a shift register part which sequentially shifts a first pulse signal in response to a clock to output a second pulse signal; and an output control part which converts the second pulse signal based on a first control signal to output a main pulse signal to the main gate line, and to convert the second pulse signal in response to the first control signal and a second control signal to output a sub pulse signal having a different output timing and a different pulse width to the sub gate line, wherein the main pulse signal and the sub pulse signal are generated in a same stage of the shift register part;

the main switching device and the sub switching device are disposed between the main gate line and the sub gate line adjacent to the main gate line; and the main switching device and the sub switching device of the color pixel area are connected to a same data line comprising an image signal.

11. The gate driver of claim 10, wherein the output control part comprises:

a main control part operable to control the second pulse signal to generate the main pulse signal; and a sub control part operable to adjust the output timing and the pulse width of the second pulse signal to generate the sub pulse signal.

12. The gate driver of claim 11, wherein the main control part comprises an AND gate with two input terminals receiving the second pulse signal and the first control signal, respectively.

13. The gate driver of claim 12, wherein the first control signal is an output enable signal controlling an output of the main control part.

14. The gate driver of claim 11, wherein the sub control part comprises an AND gate having three input terminals receiving the second pulse signal, the first control signal, and the second control signal, respectively.

15. The gate driver of claim 14, wherein the second control signal is inverted and the AND gate has three input terminals receiving the second control signal that is inverted.

16. The gate driver of claim 14, wherein the first control signal is an output enable signal controlling an output of the sub control part.

17. The gate driver of claim 14, wherein the second control signal is an output control signal controlling the output timing and the pulse width of the second pulse signal.

18. The gate driver of claim 10, wherein the first pulse signal is a vertical start signal controlling the shift register part.

19. The gate driver of claim 10, further comprising a level shifter part boosting the main pulse signal and the sub pulse signal.

20. The gate driver of claim 19, further comprising an output buffer part sequentially outputting a boosted main pulse signal and a boosted sub pulse signal through a plurality of output lines.

21. The gate driver of claim 10, wherein the sub pulse signal is outputted after the main pulse signal is outputted and the sub pulse signal is finished before the main pulse signal is finished.

22. The gate driver of claim 10, wherein a pulse width of the sub pulse signal is equal to a duration of a logic low level of the second control signal.

23. The gate driver of claim 22, wherein the second control signal is inverted prior to being applied to the output control part.

24. A display device comprising:

a display panel having pixels with a plurality of color pixel areas, each color pixel area having a main pixel and a sub pixel which display a same color a gate driver which outputs a main pulse signal for the main pixel through a main gate line connected to a main switching device and a sub pulse signal for the sub pixel through a sub gate line connected to a sub switching device within a time period while the main pulse signal is outputted; and a timing controller which outputs a plurality of control signals and a clock to drive the gate driver, wherein the main pulse signal and the sub pulse signal are generated in a same stage of the gate driver;

the main switching device and the sub switching device are disposed between the main gate line and the sub gate line adjacent to the main gate line; and the main switching device and the sub switching device of the color pixel area are connected to a same data line comprising an image signal.

25. The display device of claim 24, wherein the display device has substantially a same driving speed as a display device having only one pixel in each pixel area.

* * * * *